US010739724B2

(12) United States Patent
Tanaka et al.

(10) Patent No.: US 10,739,724 B2
(45) Date of Patent: Aug. 11, 2020

(54) IMAGE FORMING APPARATUS

(71) Applicant: BROTHER KOGYO KABUSHIKI KAISHA, Nagoya-shi, Aichi-ken (JP)

(72) Inventors: Nobuyuki Tanaka, Konan (JP); Masahito Hamaya, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/569,017

(22) Filed: Sep. 12, 2019

(65) Prior Publication Data

US 2020/0103781 A1 Apr. 2, 2020

(30) Foreign Application Priority Data

Sep. 27, 2018 (JP) ..... 2018-182489

(51) Int. Cl.
*G03G 15/02* (2006.01)
*G03G 21/16* (2006.01)
*G03G 21/18* (2006.01)

(52) U.S. Cl.
CPC ..... *G03G 21/1892* (2013.01); *G03G 15/0266* (2013.01); *G03G 21/1652* (2013.01); *G03G 2221/1892* (2013.01)

(58) Field of Classification Search
CPC ..... G03G 15/0266; G03G 15/0863; G03G 21/1652; G03G 21/1842; G03G 21/1867; G03G 21/1875–1892; G03G 2221/1892
See application file for complete search history.

(56) References Cited

U.S. PATENT DOCUMENTS 6,137,966 A * 10/2000 Uehara ..... G03G 21/1885 399/111
7,853,158 B2 * 12/2010 Mikuni ..... G03G 15/0865 399/111
2007/0058993 A1 * 3/2007 Horinoe ..... G03G 21/1896 399/13
2009/0269086 A1 10/2009 Mikuni
2013/0279921 A1 * 10/2013 Kanai ..... G03G 15/50 399/12

FOREIGN PATENT DOCUMENTS

JP 2009-265401 A 11/2009
JP 2010-60663 A 3/2010

* cited by examiner

*Primary Examiner* — Carla J Therrien
(74) *Attorney, Agent, or Firm* — Merchant & Gould P.C.

(57) ABSTRACT

An image forming apparatus includes: a main body housing; a drum cartridge; a toner cartridge, which is attachable to and detachable from the drum cartridge and includes a memory having an electrical contact surface; a connector, which is configured to be in contact with the electrical contact surface, and a controller is configured to execute: connection determination processing of determining whether electrical connection with the memory is made, electrical conduction determination processing of determining whether the applying circuit is electrically conducted with the charger, and notification processing of notifying information indicating whether the drum cartridge is mounted to the main body housing and information indicating whether the toner cartridge is mounted to the main body housing, in accordance with results of the connection determination processing and the electrical conduction determination processing.

18 Claims, 13 Drawing Sheets

FIG. 11

| | |
|---|---|
| MESSAGE A | THERE IS NO DRUM CARTRIDGE<br>PLEASE ATTACH THE TONER CARTRIDGE TO THE DRUM CARTRIDGE AND THEN MOUNT THE DRUM CARTRIDGE |
| MESSAGE B | THERE IS NO TONER CARTRIDGE<br>PLEASE ATTACH THE TONER CARTRIDGE TO THE DRUM CARTRIDGE AND THEN MOUNT THE DRUM CARTRIDGE |
| MESSAGE C | THE COLOR OF THE TONER CARTRIDGE IS WRONG<br>PLEASE MOUNT THE TONER CARTRIDGE<br>TO THE CORRECT POSITION |

IMAGE FORMING APPARATUS

CROSS-REFERENCE TO RELATED APPLICATIONS

This application is based upon and claims the benefit of priority from prior Japanese patent application No. 2018-182489, filed on Sep. 27, 2018, the entire contents of which are incorporated herein by reference.

TECHNICAL FIELD

The present disclosure relates to an image forming apparatus including a toner cartridge and a drum cartridge.

BACKGROUND ART

An image forming apparatus including a toner cartridge and a drum cartridge is known. The drum cartridge and the toner cartridge can be independently replaced, respectively. When replacing the toner cartridge, the toner cartridge is attached to the drum cartridge and then mounted to the image forming apparatus.

SUMMARY

In the image forming apparatus of which the drum cartridge and the toner cartridge can be independently replaced, respectively, only the toner cartridge may be mounted or the toner cartridge may be mounted without being attached to the drum cartridge. In this case, it is desirable to notify a user that it is necessary to attach the unmounted cartridge.

Also, in the case of a color image forming apparatus, when a toner cartridge is not mounted in a correct position corresponding to a color thereof, it is desirable to notify the user that the color is wrong.

The present disclosure provides an image forming apparatus configured to notify information indicating whether a drum cartridge is mounted and information indicating whether a toner cartridge is mounted.

Also, the present disclosure provides an image forming apparatus configured to notify the information indicating whether the drum cartridge is mounted, the information indicating whether the toner cartridge is mounted, and information indicating that the toner cartridge is wrong in terms of color.

An image forming apparatus of this disclosure includes: a main body housing; a drum cartridge, which is attachable to and detachable from the main body housing and includes a photosensitive drum and a charger configured to charge a surface of the photosensitive drum; a toner cartridge, which is attachable to and detachable from the drum cartridge and includes a memory having an electrical contact surface; an applying circuit, which is configured to apply a voltage to the charger; a connector, which is configured to be in contact with the electrical contact surface, and a controller, which is electrically connected to the applying circuit and the connector, the controller being configured to execute: communication processing of performing communication with the memory via the connector to acquire information from the memory, connection determination processing of, when the communication processing is executed, determining whether electrical connection with the memory is made, transmission processing of transmitting an instruction to apply a first voltage to the charger to the applying circuit, electrical conduction determination processing of, when the transmission processing is executed, determining whether the applying circuit is electrically conducted with the charger, and notification processing of notifying information indicating whether the drum cartridge is mounted to the main body housing and information indicating whether the toner cartridge is mounted to the main body housing, in accordance with results of the connection determination processing and the electrical conduction determination processing.

According to the above configuration, the image forming apparatus can notify the information indicating whether the drum cartridge is mounted, and the information indicating whether the toner cartridge is mounted.

An image forming apparatus of this disclosure includes: a main body housing; a plurality of drum cartridges, each of which is attachable to and detachable from to the main body housing and includes a photosensitive drum and a charger configured to charge a surface of the photosensitive drum; a plurality of toner cartridges, each of which accommodates a toner having a color different from each other, is attachable to and detachable from one of the drum cartridges and includes a memory having an electrical contact surface; a applying circuit, which is configured to apply a voltage to the chargers; a plurality of connectors, which each of which is configured to be in contact with in contact with the electrical contact surfaces, respectively, and a controller electrically connected to the applying circuits and the connectors, the controller is configured to execute: communication processing of performing communication with the respective memories via the connectors to acquire color information about the toner from the respective memories, connection determination processing of, when the communication processing is executed, determining whether electrical connection with the respective memories is made, position determination processing of, when the communication processing is executed, determining whether a color corresponding to a mounting position of each of the toner cartridges coincides with the color information, transmission processing of transmitting an instruction to apply a first voltage to each of the chargers to the applying circuits, electrical conduction determination processing of, when the transmission processing is executed, determining whether the applying circuits are electrically conducted with the respective chargers, and notification processing of notifying information indicating whether the drum cartridges are mounted to the main body housing, information indicating whether the toner cartridges are mounted to the main body housing, and information indicating that the mounting position of each of the toner cartridges is wrong in terms of color, in accordance with results of the connection determination processing, the position determination processing and the electrical conduction determination processing.

According to the above configuration, the image forming apparatus can notify the information indicating whether the drum cartridge is mounted, the information indicating whether the toner cartridge is mounted, and the information indicating that the toner cartridge is wrong in terms of color.

According to the present disclosure, it is possible to provide the image forming apparatus configured to notify the information indicating whether the drum cartridge is mounted, and the information indicating whether the toner cartridge is mounted.

Also, according to the present disclosure, it is possible to provide the image forming apparatus configured to notify the information indicating whether the drum cartridge is mounted, the information indicating whether the toner cartridge is mounted, and the information indicating that the toner cartridge is wrong in terms of color.

BRIEF DESCRIPTION OF THE DRAWINGS

The foregoing and additional features and characteristics of this disclosure will become more apparent from the following detailed descriptions considered with the reference to the accompanying drawings, wherein:

FIG. 11 depicts messages A to C.

DETAILED DESCRIPTION

Hereinafter, a first exemplary embodiment of the present disclosure will be described in detail with reference to the drawings.

Figure 1:
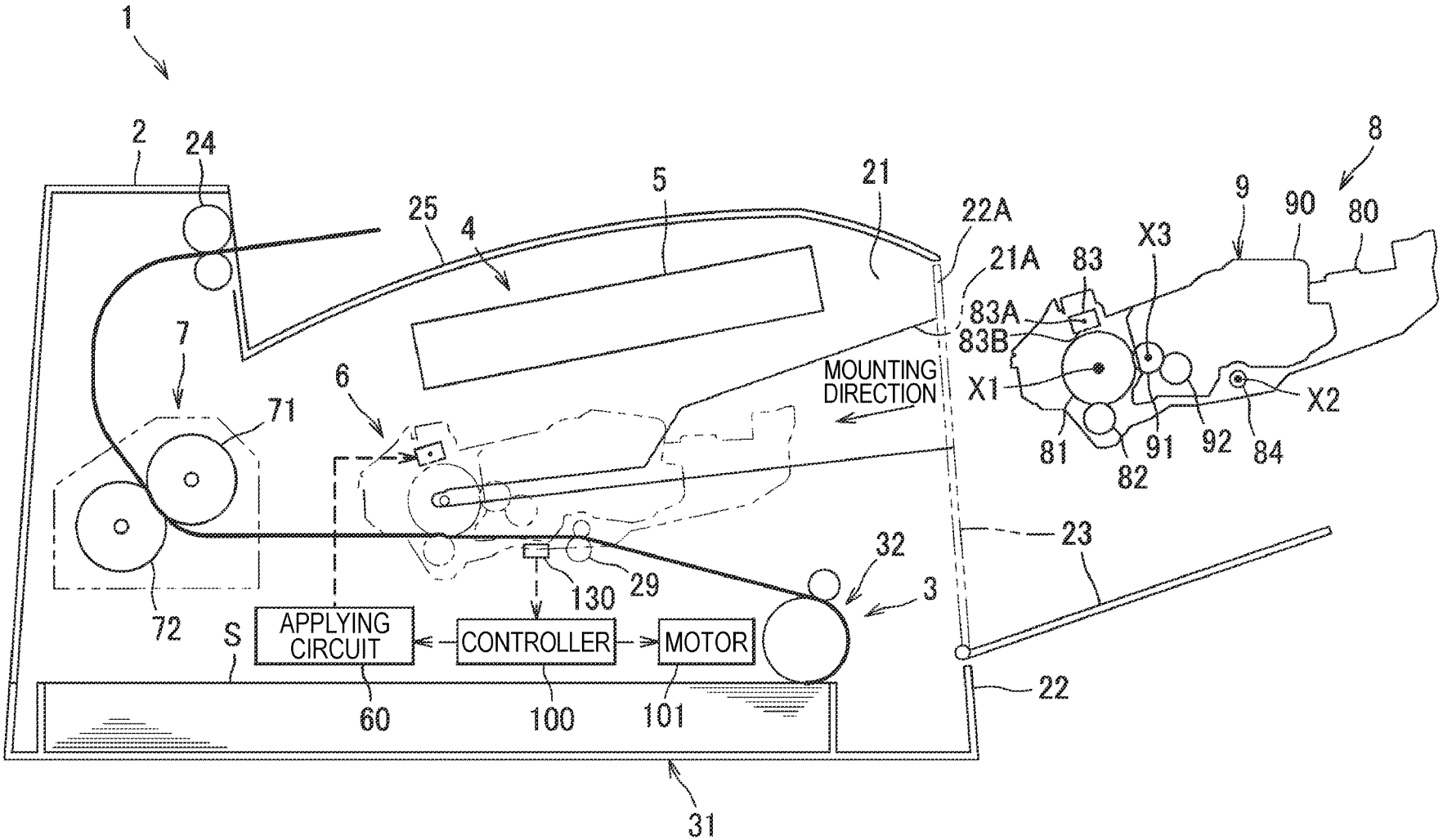
FIG. 1 is a view depicting a schematic configuration of an image forming apparatus in accordance with a first exemplary embodiment of the present disclosure.

As shown in FIG. 1, an image forming apparatus 1 is a monochrome laser printer. The image forming apparatus 1 mainly includes a main body housing 2, a feeder unit 3, an image forming unit 4, a controller 100, and a motor 101. The feeder unit 3 is configured to feed a recording sheet S into the main body housing 2. The image forming unit 4 is configured to form an image on the recording sheet S.

The main body housing 2 has a hollow case shape. The main body housing 2 has sidewalls 21, and a front wall 22 connecting the sidewalls 21. The sidewalls 21 are formed with guide grooves 21A for guiding a drum cartridge 8 (which will be described later), respectively. The front wall 22 is formed with a main body opening 22A, and is provided with a front cover 23 configured to open and close the main body opening 22A and to be swingable. The guide groove 21A extends from an inside of the main body housing 2 to the main body opening 22A.

The feeder unit 3 includes a feeding tray 31 that is attachable to and detachable from a lower part of the main body housing 2, and a feeder mechanism 32 configured to feed the recording sheet S in the feeding tray 31 toward the image forming unit 4.

The image forming unit 4 includes a scanner unit 5, a drum cartridge 8, and a fixing device 7.

The scanner unit 5 is positioned at an upper part in the main body housing 2, and includes a laser light-emitting unit, a polygon mirror, a lens, a reflector and the like, which are not shown. The scanner unit 5 is configured to scan a laser beam onto a surface of a photosensitive drum 81 (which will be described later) at high speed.

The controller 100 includes a CPU, a RAM, a ROM and an input/output circuit, for example, and is configured to execute printing control by executing computation processing on the basis of information about a mounted cartridge, a program and data stored in the ROM, and the like.

The motor 101 is configured to drive the respective members of the image forming apparatus 1.

The drum cartridge 8 is arranged between the feeder unit 3 and the scanner unit 5. The drum cartridge 8 is attachable to and detachable from the main body housing 2 in a mounting direction, through the main body opening 22A that is to be opened and closed by the front cover 23 of the main body housing 2. The drum cartridge 8 is attached and detached along the guide grooves 21A formed in the main body housing 2. That is, the mounting direction is a direction along the guide groove 21A.

The drum cartridge 8 is configured so that a toner cartridge 9 can be separated therefrom. The toner cartridge 9 is attachable to and detachable from the drum cartridge 8. The drum cartridge 8 is attachable to and detachable from the main body housing 2.

The drum cartridge 8 mainly includes a frame 80 to which the toner cartridge 9 can be mounted, a photosensitive drum 81, a transfer roller 82, a charger 83, and a pinch roller 84. The photosensitive drum 81 is configured to be rotatable about a first axis X1 extending in an axis direction. The axis direction is a first intersection direction intersecting with the mounting direction. In the first exemplary embodiment, the axis direction is perpendicular to the mounting direction.

The charger 83 includes a wire electrode 83A, and a grid electrode 83B. The charger 83 is a scorotron-type charger. A voltage is applied to the charger 83 by an applying circuit 60, so that the charger 83 generates a corona discharge, thereby charging a surface of the photosensitive drum 81.

Figure 2:
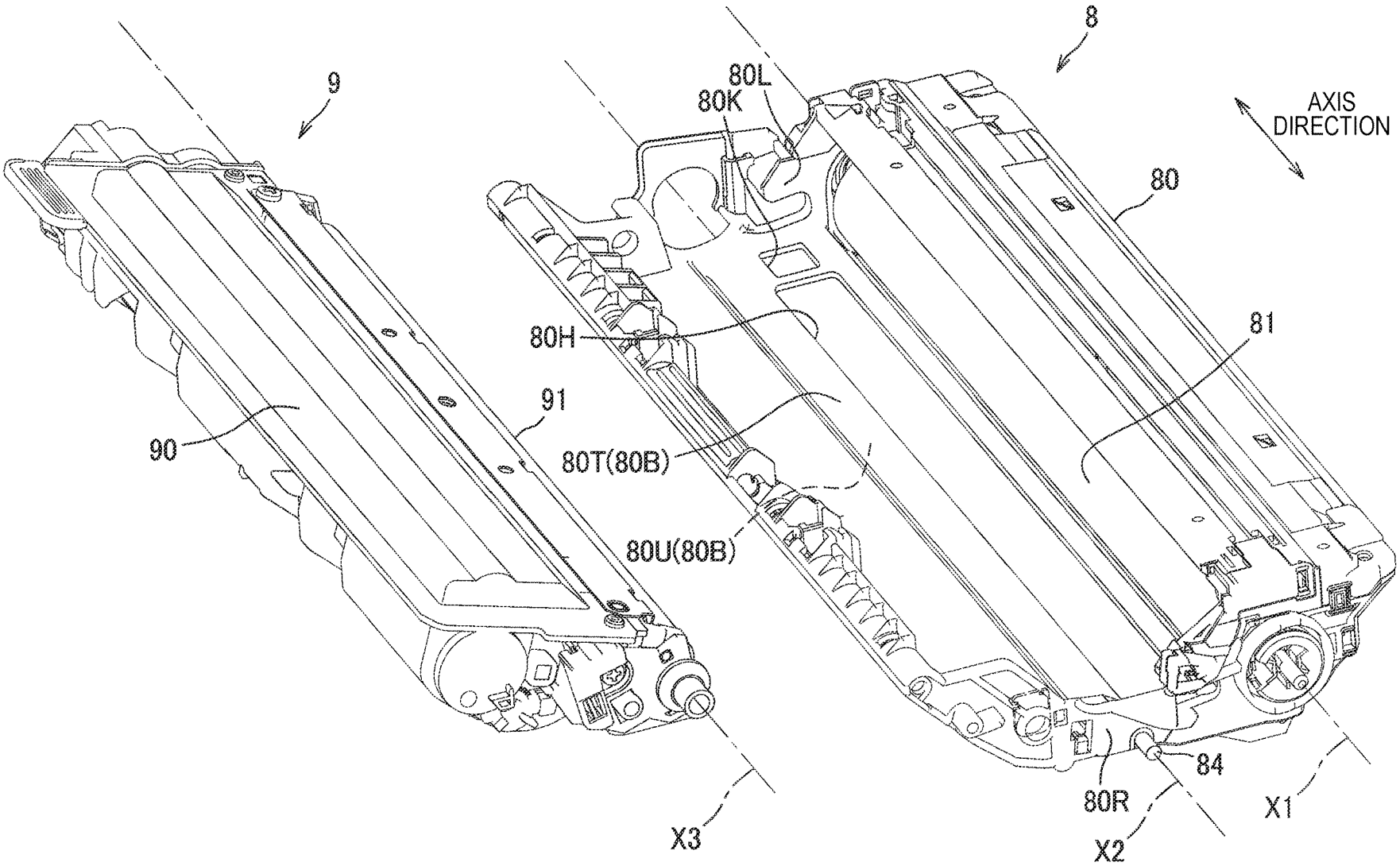
FIG. 2 is a perspective view depicting a drum cartridge from which a toner cartridge is detached.

As shown in FIG. 2, the frame 80 has a first side frame 80L, a second side frame 80R, a bottom frame 80B, a first opening 80K, and a second opening 80H. The first side frame 80L is located at one end portion of the frame 80 in the axis direction. The second side frame 80R is located at the other end portion of the frame 80 in the axis direction. The first side frame 80L and the second side frame 80R intersect with each other in the axis direction. The toner cartridge 9 is configured to be mountable between the first side frame 80L and the second side frame 80R.

The bottom frame 80B connects the first side frame 80L and the second side frame 80R. The bottom frame 80B has a first surface 80T, a second surface 80U, a first opening 80K and a second opening 80H. The first surface 80T is a surface that faces the toner cartridge 9 in a state in which the toner cartridge 9 is mounted to the frame 80. The second surface 80U is an opposite surface to the first surface 80T. The first opening 80K has a rectangular shape. The first opening 80K is located at one end portion of the bottom frame 80B in the axis direction. The second opening 80H has a rectangular shape. The second opening 80H and the first opening 80K are aligned side by side in the axis direction. The second opening 80H extends in the axis direction.

The pinch roller 84 is located at an opposite side to the toner cartridge 9 with the bottom frame 80B being interposed therebetween. The pinch roller 84 is rotatable about a second axis X2 extending in the axis direction. As shown in FIG. 1, the pinch roller 84 is arranged to face a registration roller 29 arranged in the main body housing 2. The pinch roller 84 is configured to guide the recording sheet S together with the registration roller 29. In the meantime, the registration roller 29 is located upstream of the photosensitive drum 81 with respect to a conveying direction in which the recording sheet S is conveyed.

The toner cartridge 9 mainly includes a housing 90 configured to accommodate therein toner, a developing roller 91, and a supply roller 92. The developing roller 91 is configured to be rotatable about a third axis X3 extending in the axis direction. The developing roller 91 is configured to supply the toner to the photosensitive drum 81. The supply roller 92 is configured to supply the toner in the housing 90 to the developing roller 91.

In the drum cartridge 8, after the surface of the photosensitive drum 81 being rotated is uniformly charged by the charger 83, it is exposed by the high-speed scanning of the laser beam emitted from the scanner unit 5. Thereby, a potential of the exposed part is lowered, so that an electrostatic latent image based on image data is formed on the surface of the photosensitive drum 81.

Then, the toner in the toner cartridge 9 is supplied to the electrostatic latent image on the photosensitive drum 81 by the developing roller 91 being rotationally driven, so that a toner image is formed on the surface of the photosensitive drum 81. Thereafter, the recording sheet S is conveyed between the photosensitive drum 81 and the transfer roller 82, so that the toner image carried on the surface of the photosensitive drum 81 is transferred onto the recording sheet S.

The fixing device 7 includes a heating roller 71, and a pressing roller 72 arranged to face the heating roller 71 and configured to press the heating roller 71. In the fixing device 7 configured in this way, the toner transferred on the recording sheet S is heat-fixed while the recording sheet S passes between the heating roller 71 and the pressing roller 72.

In the meantime, the recording sheet S heat-fixed by the fixing device 7 is conveyed to sheet discharge rollers 24 arranged downstream of the fixing device 7, and is delivered onto a sheet discharge tray 25 from the sheet discharge rollers 24.

Figure 3:
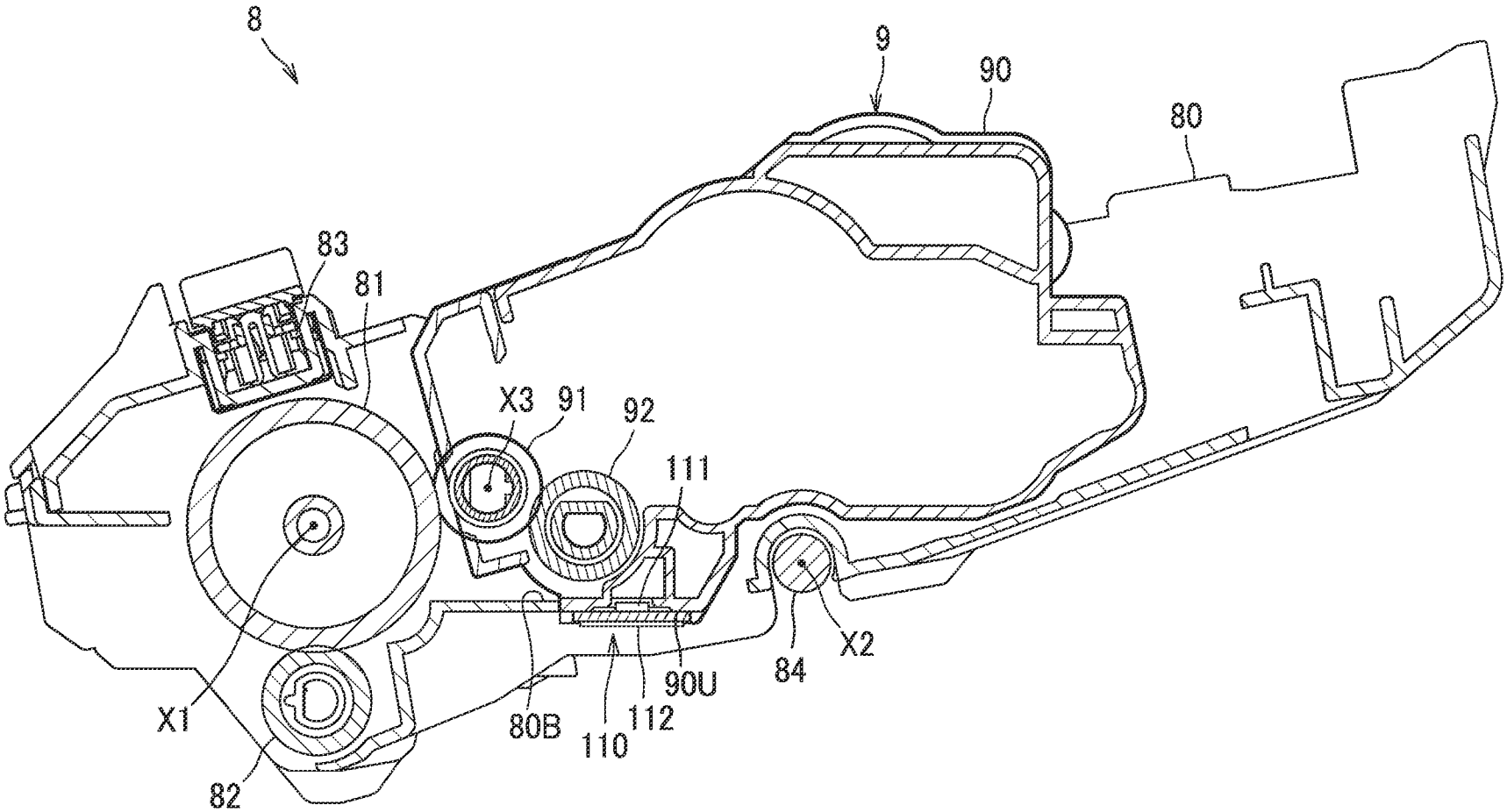
FIG. 3 is a sectional view of the drum cartridge.

As shown in FIG. 3, the toner cartridge 9 includes an IC chip 110, which is an example of a memory. The IC chip 110 is located at a bottom surface 90U, at which the housing 90 faces the bottom frame 80B when the toner cartridge 9 is mounted to the drum cartridge 8. The IC chip 110 is fixed to the toner cartridge 9 by adhesion.

The IC chip 110 includes a storage element 111, and electrical contact surfaces 112. In the storage element 111 of the IC chip 110, product information about the toner cartridge 9 is stored.

Figure 4:
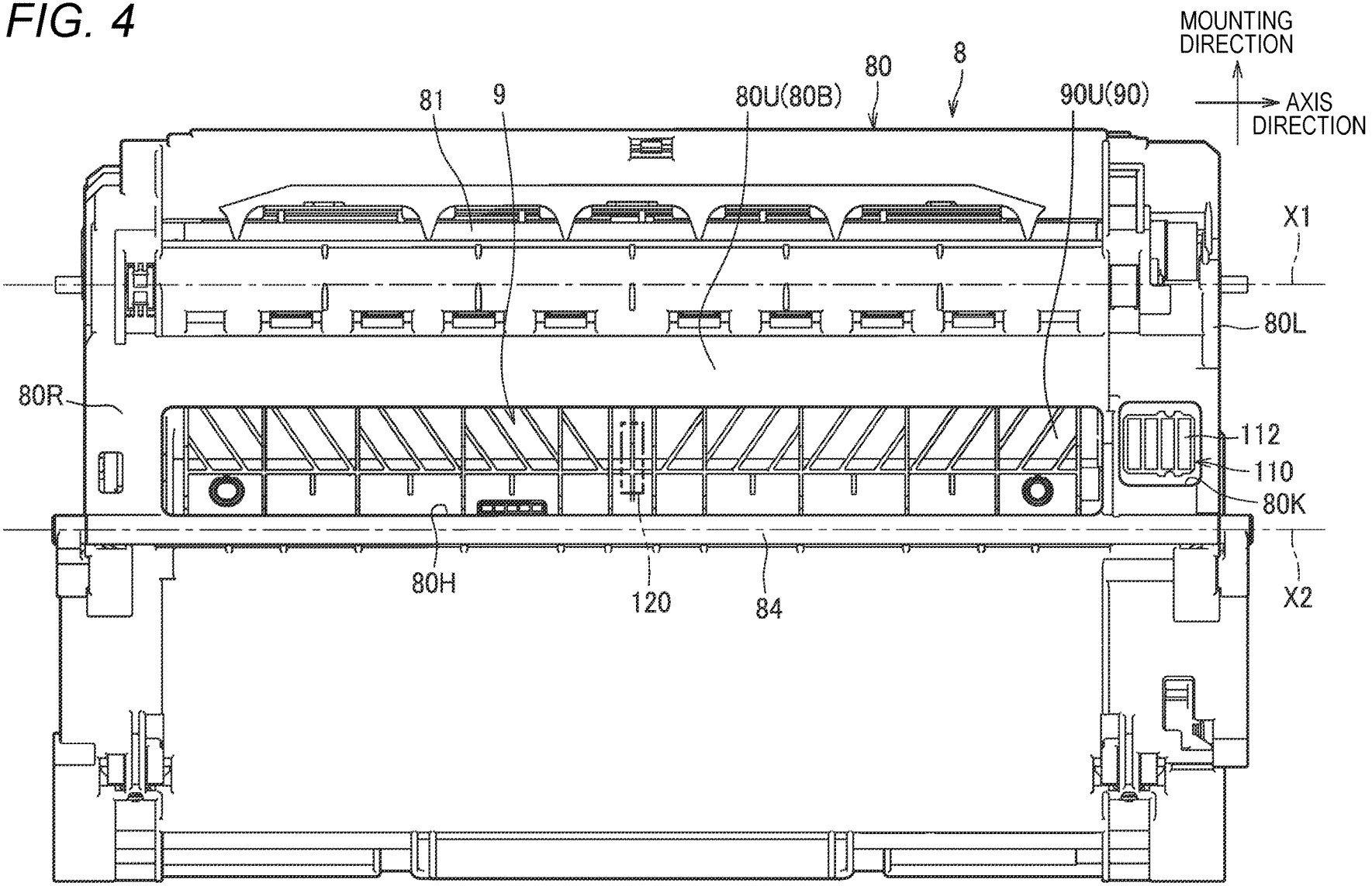
FIG. 4 depicts the drum cartridge, as seen from below.

As shown in FIG. 4, the IC chip 110 is located at one end side of the housing 90 in the axis direction. In the state in which the toner cartridge 9 is mounted to the drum cartridge 8, the IC chip 110 is exposed from the first opening 80K.

The electrical contact surface 112 is made of a metal layer arranged on a surface of a substrate. A surface of the electrical contact surface 112 is planar. A plurality of the electrical contact surfaces 112 is arranged. The plurality of electrical contact surfaces 112 has a rectangular shape extending in the mounting direction, respectively. The plurality of electrical contact surfaces 112 is aligned side by side with slight intervals in the axis direction.

Figures 5A, 5B:
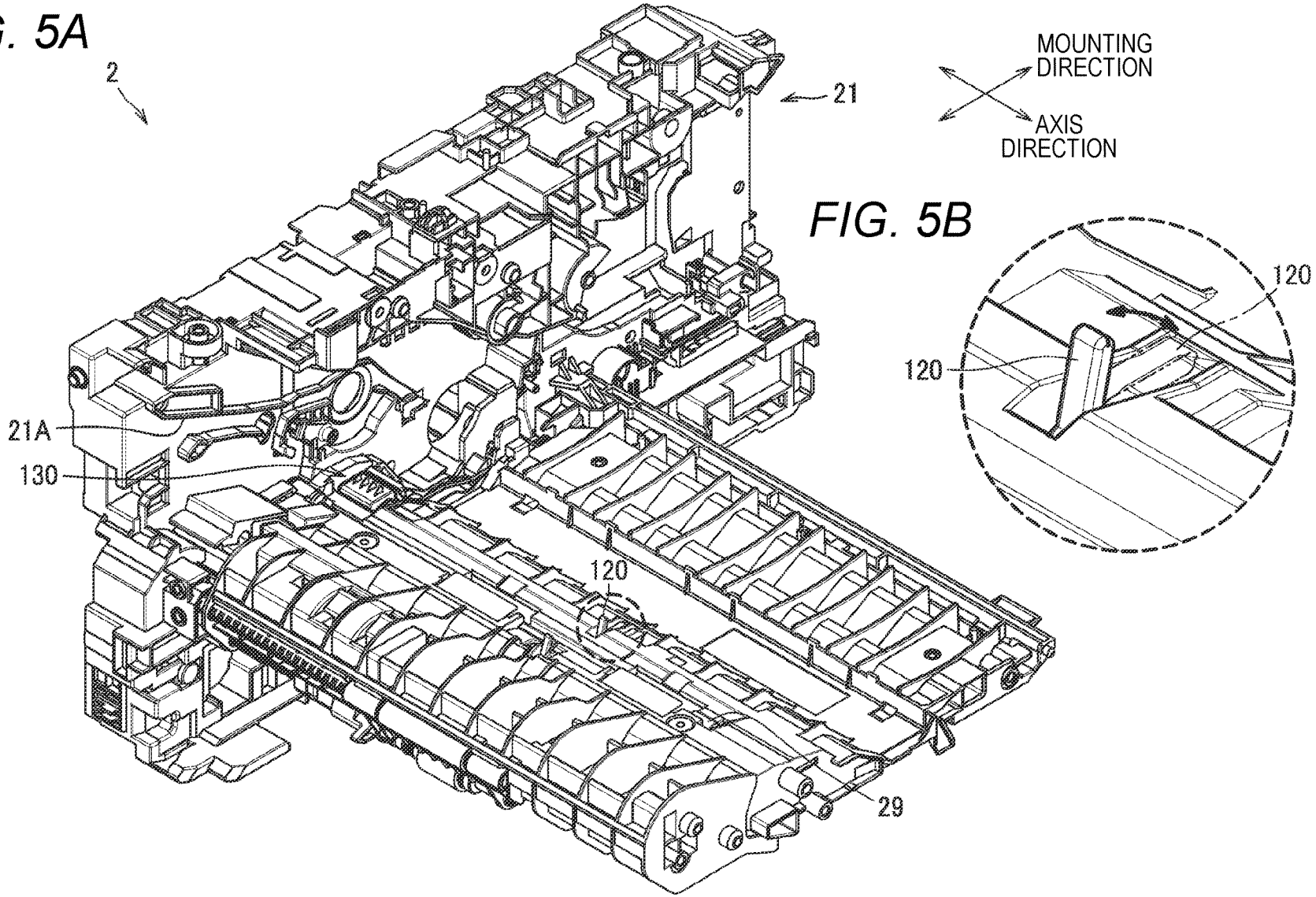
FIG. 5A is a perspective view depicting arrangements of a connector and a contact-type sensor in the image forming apparatus.
FIG. 5B is an enlarged view in the vicinity of the contact-type sensor.

As shown in FIG. 5A, the sidewall 21 of one end side of the main body housing 2 is provide with a connector 130. Specifically, the connector 130 is arranged below the guide groove 21A of the sidewall 21. The connector 130 is electrically contacted to the electrical contact surfaces 112 when the drum cartridge 8 is mounted to the main body housing 2. The connector 130 is electrically connected to the controller 100 (refer to FIG. 1). Thereby, the controller 100 can perform communication with the IC chip 110 via the connector 130. In the meantime, the controller 100 can be electrically connected to the IC chip 110 via the connector 130, too.

The main body housing 2 is further provided with a contact-type sensor 120. The contact-type sensor 120 is located at a substantial center of the main body housing 2 in the axis direction. When the drum cartridge 8 is mounted to the main body housing 2, the contact-type sensor 120 is located between the photosensitive drum 81 and the registration roller 29 in the conveying direction.

The contact-type sensor 120 is configured to be movable between a first position (a position shown with the solid line in FIG. 5B) and a second position (a position shown with the dashed-two dotted line in FIG. 5B). As shown in FIG. 4, when the toner cartridge 9 is mounted to the main body housing 2, the contact-type sensor 120 is brought into contact with the toner cartridge 9 through the second opening 80H and is moved from the first position to the second position.

Figure 6A:
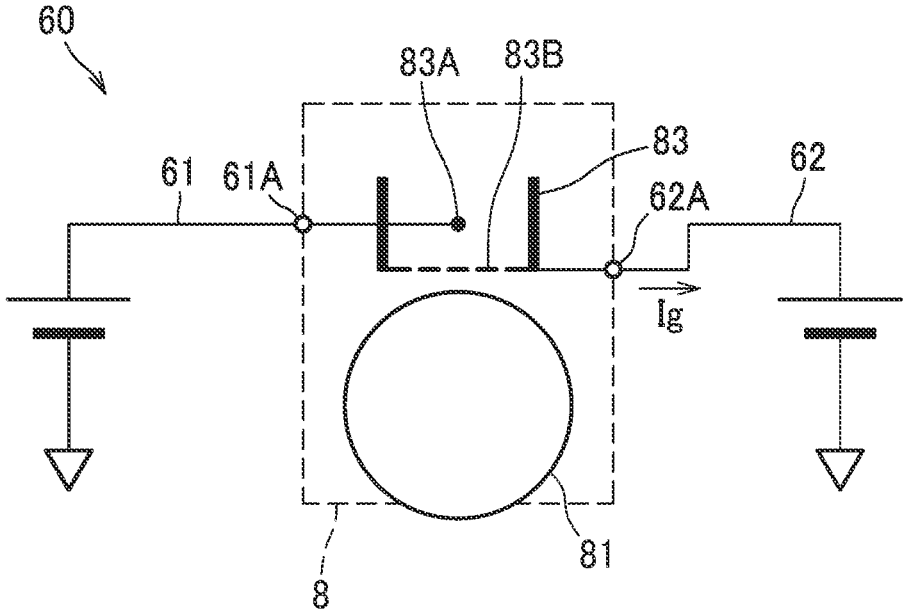
FIG. 6A is a circuit diagram of an applying circuit when the drum cartridge is mounted.

The applying circuit 60 is a circuit configured to apply a voltage to the charger 83. As shown in FIG. 6A, the applying circuit 60 includes a wire electrode applying unit 61 and a grid electrode applying unit 62. The wire electrode applying unit 61 can apply a voltage to the wire electrode 83A. The grid electrode applying unit 62 can apply a voltage to the grid electrode 83B. The wire electrode applying unit 61 can apply a voltage higher than the grid electrode applying unit 62. The wire electrode applying unit 61 has a contact point 61A. The contact point 61A is a contact point for electrical conduction with the wire electrode 83A of the charger 83. The grid electrode applying unit 62 has a contact point 62A. The contact point 62A is a contact point for electrical conduction with the grid electrode 83B.

When the drum cartridge 8 is mounted to the image forming apparatus 1, the contact point 61A is connected to the wire electrode 83A and can be thus electrically conducted and the contact point 62A is connected to the grid electrode 83B and can be thus electrically conducted. In this state, when the controller 100 instructs the applying circuit 60 to apply a voltage, the voltage is applied to the wire electrode 83A and the grid electrode 83B, so that grid current Ig flows through the grid electrode applying unit 62. When the grid current Ig flows, information, which indicates that the grid current Ig flows, is sent to the controller 100.

Figure 6B:
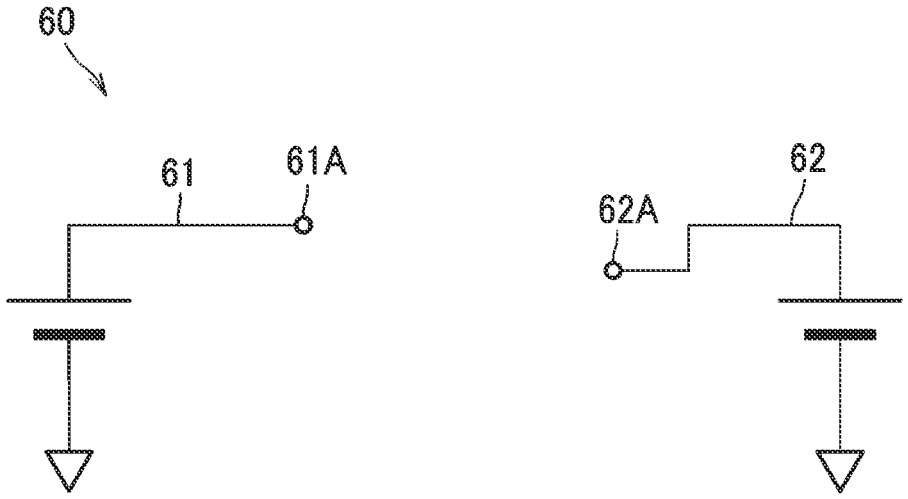
FIG. 6B is a circuit diagram of the applying circuit when the drum cartridge is not mounted.

On the other hand, as shown in FIG. 6B, in the case that the drum cartridge 8 is not mounted to the image forming apparatus 1, even when the controller 100 instructs the applying circuit 60 to apply a voltage, the grid current Ig does not flow through the grid electrode applying unit 62.

The controller 100 is configured to execute communication processing, connection determination processing, transmission processing, electrical conduction determination processing, and notification processing.

The controller 100 is configured to perform communication with the IC chip 110 via the connector 130. The communication processing is processing of acquiring information from the IC chip 110. The connection determination processing is processing of, when the communication processing is executed, determining whether communication with the IC chip 110 is performed. In the meantime, as the connection determination processing, the controller 100 may determine whether the connector 130 and the IC chip 110 is electrically connected to each other.

The transmission processing is processing of transmitting an instruction to apply a first voltage V1 to the charger 83 to the applying circuit 60. The electrical conduction determination processing is processing of, when the transmission processing is executed, determining whether the applying circuit 60 is electrically conducted with the charger 83. In a case that it is detected that the grid current Ig flows through the grid electrode applying unit 62 when the instruction to cause the applying circuit 60 to apply the voltage is transmitted, the controller 100 may determine that the applying circuit 60 is electrically conducted with the charger 83.

The notification processing is processing of notifying information indicating whether the drum cartridge 8 is mounted to the main body housing 2 and information indicating whether the toner cartridge 9 is mounted to the main body housing 2, in accordance with results of the connection determination processing and the electrical conduction determination processing.

When the controller 100 determines that communication with the IC chip 110 is performed (or the controller 100 determines that the connector 130 and the IC chip 110 is electrically connected to each other) and determines that the electrical conduction with the charger 83 is made, the controller 100 determines that the toner cartridge 9 is mounted and the drum cartridge 8 is mounted.

When the controller 100 determines that communication with the IC chip 110 is performed (or the controller 100 determines the connector 130 and the IC chip 110 is electrically connected to each other) and determines that the electrical conduction with the charger 83 is not made, the controller 100 determines that the toner cartridge 9 is mounted and the drum cartridge 8 is not mounted.

When the controller 100 determines that communication with the IC chip 110 is not performed (or the controller 100 determines the connector 130 and the IC chip 110 is not electrically connected to each other) and determines that the electrical conduction with the charger 83 is made, the controller 100 determines that the toner cartridge 9 is not mounted and the drum cartridge 8 is mounted.

When the controller 100 determines that communication with the IC chip 110 is not performed (or the controller 100 determines the connector 130 and the IC chip 110 is not electrically connected to each other) and determines that the electrical conduction with the charger 83 is not made, the controller 100 determines that the toner cartridge 9 is not mounted and the drum cartridge 8 is not mounted.

When the controller determines that the toner cartridge 9 is mounted and the drum cartridge 8 is not mounted or determines that the toner cartridge 9 is not mounted and the drum cartridge 8 is mounted, the controller notifies a user that it is necessary to attach the toner cartridge 9 to the drum cartridge 8, which is then to be attached to the main body housing 2.

When the controller 100 receives a signal indicating that the contact-type sensor 120 is located at the second position, the controller 100 may determine that the toner cartridge 9 is mounted. On the other hand, when the controller 100 receives a signal indicating that the contact-type sensor 120 is located at the first position, the controller 100 may determine that the toner cartridge 9 is not mounted.

Subsequently, an example of processing that is to be executed by the controller 100 is described with reference to a flowchart of FIG. 7.

Figure 7:
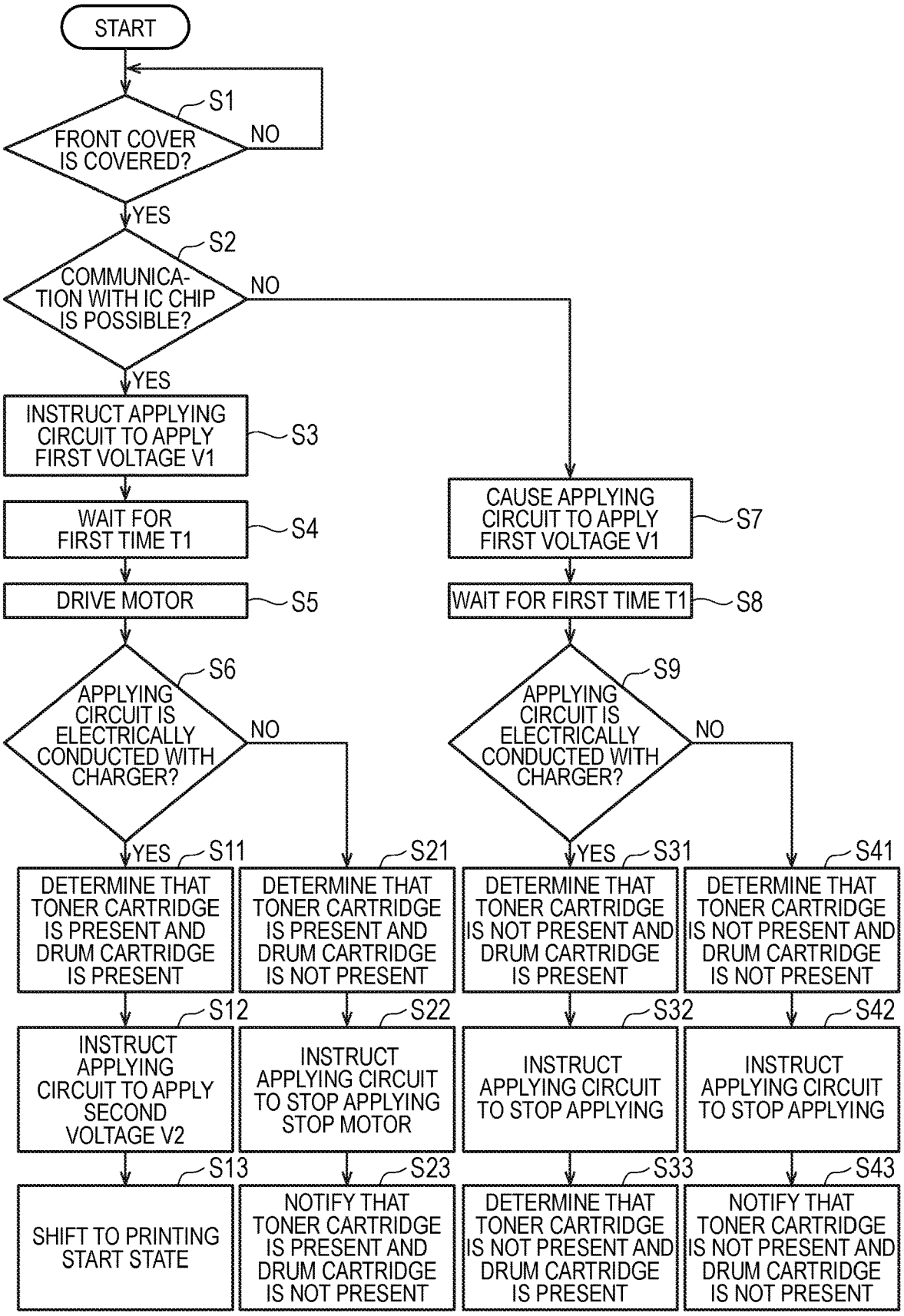
FIG. 7 is a flowchart depicting processing of a controller in the first exemplary embodiment.

As shown in FIG. 7, in the case that the front cover 23 is opened, the controller 100 determines whether the front cover 23 is closed (S1).

When the controller 100 determines in step S1 that the front cover 23 is not closed (S1, No), the controller 100 repeatedly executes the determination processing of step S1.

On the other hand, when the controller 100 determines that the front cover 23 is closed (S1, Yes), the controller 100 tries to perform communication with the IC chip 110 of the toner cartridge 9, and determines whether it is possible to perform communication with the IC chip 110 (or the controller 100 determines whether the connector 130 and the IC chip 110 can be electrically connected to each other) (S2, the communication processing, the connection determination processing).

In the meantime, in step S2, the controller 100 may determine that it is possible to perform communication with the IC chip 110 (or the controller 100 may determine that the connector 130 and the IC chip 110 is electrically connected to each other), and may determine whether the contact-type sensor 120 is located at the second position. That is, when it is determined that it is possible to perform communication with the IC chip 110 (or the connector 130 and the IC chip 110 can be electrically connected to each other) and that the contact-type sensor 120 is located at the second position, the controller 100 may execute processing of step S3.

When the controller 100 determines in step S2 that it is possible to perform communication with the IC chip 110 (or the connector 130 and the IC chip 110 can be electrically connected to each other) (or the controller 100 determines that the connector 130 and the IC chip 110 is electrically connected to each other) (S2, Yes), the controller 100 instructs the applying circuit 60 to apply the first voltage V1 (S3, the transmission processing). In the meantime, the first voltage V1 is a voltage lower than a second voltage V2, which will be described later.

After step S3, the controller 100 waits for first time T1 (S4), and drives the motor 101 (S5). After step S5, the controller 100 determines whether the applying circuit 60 is electrically conducted with the charger 83 (S6, the electrical conduction determination processing). The first time T1 is a predetermined value stored in advance in the controller 100. The first time T1 is time slightly longer than a time period after the applying circuit 60 is instructed to apply the first voltage V1 until the grid current Ig flows through the grid electrode 83B. When the motor 101 is driven, the photosensitive drum 81 and the like are rotated for shift to a printing start state.

When the controller 100 determines in step S6 that the applying circuit 60 is electrically conducted with the charger 83 (S6, Yes), the controller 100 determines that the toner cartridge 9 is mounted (the toner cartridge is present) and the drum cartridge 8 is mounted (the drum cartridge is present) (S11).

After step S11, the controller 100 causes the applying circuit 60 to apply a second voltage V2 (S12) and shifts to a printing start state (S13). In the meantime, the second voltage V2 is a voltage that is to be applied to the charger 83 when an image formation command is received.

On the other hand, when the controller 100 determines in step S6 that the applying circuit 60 is not electrically conducted with the charger 83 (S6, No), the controller 100 determines that the toner cartridge 9 is mounted (the toner cartridge is present) and the drum cartridge 8 is not mounted (the drum cartridge is not present) (S21).

After step S21, the controller 100 determines that it is not necessary to shift to the printing start state, stops the applying of the applying circuit 60, and stops the motor 101 (S22). After step S22, the controller 100 notifies the user that the toner cartridge is present and the drum cartridge is not present (S23, the notification processing). At this time, the controller 100 may notify the user that it is necessary to attach (set) the toner cartridge 9 to the drum cartridge 8 and then to mount the drum cartridge 8 to the main body housing 2.

When it is determined in step S2 that it is not possible to perform communication with the IC chip 110 (or the connector 130 and the IC chip 110 are not electrically connected to each other) (S2, No), the controller 100 instructs the applying circuit 60 to apply the first voltage V1 (S7).

After step S7, the controller 100 waits for the first time T1 (S8), and determines whether the applying circuit 60 is electrically conducted with the charger 83 (S9).

When the controller 100 determines in step S9 that the applying circuit 60 is electrically conducted with the charger 83 (S9, Yes), the controller 100 determines that the toner cartridge 9 is not mounted (the toner cartridge is not present) and the drum cartridge 8 is mounted (the drum cartridge is present) (S31). At this time, the controller 100 may notify the user that it is necessary to attach (set) the toner cartridge 9 to the drum cartridge 8 and then to mount the drum cartridge 8 to the main body housing 2.

After step S31, the controller 100 determines that it is not necessary to shift to the printing start state, and stops the instruction to cause the applying circuit 60 to apply the first voltage V1 (S32). After step S32, the controller 100 notifies the user that the toner cartridge is not present and the drum cartridge is present (S33, the notification processing).

On the other hand, when the controller 100 determines in step S9 that the applying circuit 60 is not electrically conducted with the charger 83 (S9, No), the controller 100 determines that the toner cartridge 9 is not mounted (the toner cartridge is not present) and the drum cartridge 8 is not mounted (the drum cartridge is not present) (S41).

After step S41, the controller 100 determines that it is not necessary to shift to the printing start state, and stops the instruction to cause the applying circuit 60 to apply the first voltage V1 (S42). After step S42, the controller 100 notifies the user that the toner cartridge is not present and the drum cartridge is not present (S43, the notification processing).

The operations and effects of the image forming apparatus 1 configured as described above are described.

According to the image forming apparatus 1, it is possible to notify the information indicating whether the drum cartridge 8 is mounted to the main body housing 2 and the information indicating whether the toner cartridge 9 is mounted to the main body housing 2, in accordance with the results of the connection determination processing, and the electrical conduction determination processing. For this reason, when only one of the drum cartridge 8 and the toner cartridge 9 is mounted, it is possible to notify the user that it is necessary to mount the unmounted cartridge.

Also, when the controller 100 determines that the toner cartridge 9 is mounted and the drum cartridge 8 is not mounted or determines that the toner cartridge 9 is not mounted and the drum cartridge 8 is mounted, the controller 100 notifies the user that it is necessary to attach the toner cartridge 9 to the drum cartridge 8 and then to mount the drum cartridge 8 to the main body housing 2. For this reason, even when the user does not know that it is possible to replace only the toner cartridge by detaching the toner cartridge 9 from the drum cartridge 8, it is possible to notify the user that it is possible to replace only the toner cartridge 9.

Also, since the first voltage V1 upon the execution of the electrical conduction determination processing is lower than the second voltage V2 upon the execution of the image formation, the rise time of the charger 83 is shortened, so that it is possible to execute the electrical conduction determination processing in a short time. Also, it is possible to suppress the power consumption of the electrical conduction determination processing.

By the contact-type sensor 120, it is possible to determine that the toner cartridge 9 is mounted to the main body housing 2. The controller 100 can more securely determine that the toner cartridge 9 is mounted, by executing the mounting determination by the contact-type sensor 120, in addition to the connection determination processing.

Subsequently, a second exemplary embodiment of the present disclosure will be described in detail with reference to the drawings. In descriptions below, the members having substantially the same structures as the first exemplary embodiment are denoted with the same reference numerals, and the descriptions thereof are omitted.

Figure 8:
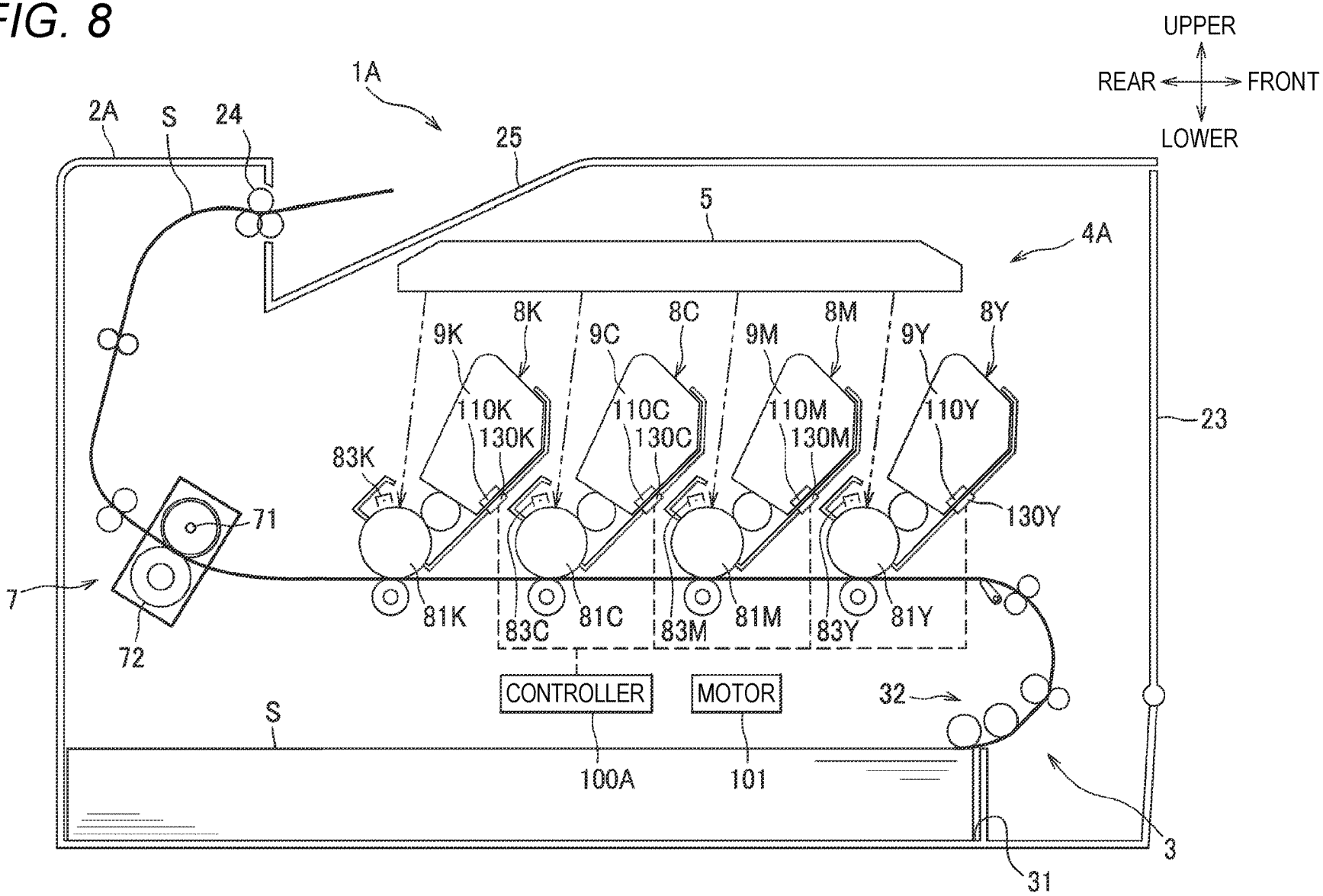
FIG. 8 is a view depicting a schematic configuration of an image forming apparatus in accordance with a second exemplary embodiment.

As shown in FIG. 8, an image forming apparatus 1A is a color laser printer. The image forming apparatus 1A includes, in a main body housing 2A, an image forming unit 4A, a controller 100A and the like.

The image forming unit 4A includes a plurality of drum cartridges. In the second exemplary embodiment, the four drum cartridges are provided, in correspondence to toners of four colors. The four drum cartridges correspond to the toners of yellow (Y), magenta (M), cyan (C) and black (K), and are arranged side by side in corresponding order from an upstream side toward a downstream side with respect to the conveying direction of the recording sheet S. In descriptions below, the reference numerals Y, M, C, K are denoted, like the drum cartridges 8Y, 8M, 8C, 8K, so as to distinguish the respective colors.

The respective drum cartridges 8Y, 8M, 8C, 8K and the respective toner cartridges 9Y, 9M, 9C, 9K can be independently replaced. The respective toner cartridges 9Y, 9M, 9C, 9K can be independently attached and detached to and from the respective drum cartridges 8Y, 8M, 8C, 8K. The respective drum cartridges 8Y, 8M, 8C, 8K can be independently mounted and demounted to and from the main body housing 2A.

The respective drum cartridges 8Y, 8M, 8C, 8K include photosensitive drums 81Y, 81M, 81C, 81K and chargers 83Y, 83M, 83C, 83K, respectively. The respective chargers 83Y, 83M, 83C, 83K are provided with applying circuits (not shown) configured to apply a voltage, respectively.

In the respective toner cartridges 9Y, 9M, 9C, 9K, toners of different colors are respectively accommodated. The respective toner cartridges 9Y, 9M, 9C, 9K include IC chips 110Y, 110M, 110C, 110K, respectively, as an example of the memory. In the storage elements of the respective IC chips 110Y, 110M, 110C, 110K, color information and product information corresponding to the respective toner cartridges 9Y, 9M, 9C, 9K are stored.

The main body housing 2 is provided with four connectors 130Y, 130M, 130C, 130K, in correspondence to the respective IC chips 110Y, 110M, 110C, 110K. The respective connectors 130Y, 130M, 130C, 130K are brought into contact with electrical contact surfaces of the respective IC chips 110Y, 110M, 110C, 110K when the respective drum cartridges 8Y, 8M, 8C, 8K are mounted to the main body housing 2A. The respective connectors 130Y, 130M, 130C, 130K are electrically connected to the controller 100A. Thereby, the controller 100A can perform communication with (or can be electrically connected to) the IC chips 110Y, 110M, 110C, 110K via the connectors 130Y, 130M, 130C, 130K. The information about the respective toner cartridges 9Y, 9M, 9C, 9K read through the respective connectors 130Y, 130M, 130C, 130K is transmitted to the controller 100.

The controller 100A can execute communication processing, connection determination processing, position determination processing, transmission processing, electrical conduction determination processing, and notification processing. Since the communication processing, the connection determination processing, the transmission processing and the electrical conduction determination processing are the same as the first exemplary embodiment, the descriptions thereof are omitted.

The position determination processing is processing of, when the communication processing is executed, determining whether the colors corresponding to the mounting positions of the respective toner cartridges 9Y, 9M, 9C, 9K coincide with the color information acquired in the communication processing. In the meantime, the colors corresponding to the mounting positions of the respective toner cartridges 9Y, 9M, 9C, 9K are stored in advance in the controller 100A.

The notification processing is processing of notifying information indicating whether each of the drum cartridges 8Y, 8M, 8C, 8K is mounted to the main body housing 2A, information indicating whether each of the toner cartridges 9Y, 9M, 9C, 9K is mounted to the main body housing 2A, and information indicating that the mounting position of each of the toner cartridges 9Y, 9M, 9C, 9K is wrong in terms of color, in accordance with results of the connection determination processing, the position determination processing and the electrical conduction determination processing.

When the controller 100A determines that communication with all the IC chips 110Y, 110M, 110C, 110K is performed (or the controller 100A determines that all the IC chips 110Y, 110M, 110C, 110K and the connectors 130 are electrically connected to each other), the colors corresponding to the mounting positions of all the toner cartridges 9Y, 9M, 9C, 9K coincide with the color information and the applying circuits are electrically conducted with all the chargers 83, the controller 100A determines that all the toner cartridges 9Y, 9M, 9C, 9K are mounted, all the toner cartridges 9Y, 9M, 9C, 9K are not wrong in terms of color and all the drum cartridges 8Y, 8M, 8C, 8K are mounted.

When the controller 100A determines that communication with all the IC chips 110Y, 110M, 110C, 110K is performed (or the controller 100A determines that all the IC chips 110Y, 110M, 110C, 110K and the connectors 130 are electrically connected to each other), the colors corresponding to the mounting positions of all the toner cartridges 9Y, 9M, 9C, 9K coincide with the color information and the applying circuits are not electrically conducted with at least one of the chargers 83Y, 83M, 83C, 83K, the controller 100A determines that all the toner cartridges 9Y, 9M, 9C, 9K are mounted (all the toner cartridges are present), all the toner cartridges 9Y, 9M, 9C, 9K are not wrong in terms of color and at least one of the drum cartridges 8Y, 8M, 8C, 8K is not mounted (at least one of the drum cartridges is not present).

When the controller 100A determines that communication with all the IC chips 110Y, 110M, 110C, 110K is performed (or the controller 100A determines that all the IC chips 110Y, 110M, 110C, 110K and the connectors 130 are electrically connected to each other), the color corresponding to the mounting position of at least one of the toner cartridges 9 does not coincide with the color information and the applying circuits are electrically conducted with all the chargers 83Y, 83M, 83C, 83K, the controller 100A determines that all the toner cartridges 9Y, 9M, 9C, 9K are mounted (all the toner cartridges are present), at least one of the toner cartridges 9Y, 9M, 9C, 9K is wrong in terms of color and all the drum cartridges 8Y, 8M, 8C, 8K are mounted (all the drum cartridges are present).

When the controller 100A determines that communication with all the IC chips 110Y, 110M, 110C, 110K is performed (or the controller 100A determines that all the IC chips 110Y, 110M, 110C, 110K and the connectors 130 are electrically connected to each other), the color corresponding to the mounting position of at least one of the toner cartridges 9 does not coincide with the color information and the applying circuits are not electrically conducted with at least one of the chargers 83Y, 83M, 83C, 83K, the controller 100A determines that all the toner cartridges 9Y, 9M, 9C, 9K are mounted (all the toner cartridges are present), at least one of the toner cartridges 9Y, 9M, 9C, 9K is wrong in terms of color and at least one of the drum cartridges 8Y, 8M, 8C, 8K is not mounted (at least one of the drum cartridges is not present).

When the controller 100A determines that communication with at least one of the IC chips 110Y, 110M, 110C, 110K is not performed (or the controller 100A determines that at least one of the IC chips 110Y, 110M, 110C, 110K and the connectors 130 are not electrically connected to each other), the colors corresponding to the mounting positions of the communicated toner cartridges 9 coincide with the color information and the applying circuits are electrically conducted with all the chargers 83Y, 83M, 83C, 83K, the controller 100A determines that at least one of the toner cartridges 9Y, 9M, 9C, 9K is not mounted (at least one of the toner cartridges is not present), the communicated toner cartridges 9Y, 9M, 9C, 9K are not wrong in terms of color and all the drum cartridges 8Y, 8M, 8C, 8K are mounted (all the drum cartridges are present).

When the controller 100A determines that communication with at least one of the IC chips 110Y, 110M, 110C, 110K is not performed (or the controller 100A determines that at least one of the IC chips 110Y, 110M, 110C, 110K and the connectors 130 are not electrically connected to each other), the colors corresponding to the mounting positions of the communicated toner cartridges 9Y, 9M, 9C, 9K coincide with the color information and the applying circuits are not electrically conducted with at least one of the chargers 83Y, 83M, 83C, 83K, the controller 100A determines that at least one of the toner cartridges 9Y, 9M, 9C, 9K is not mounted (at least one of the toner cartridges is not present), the communicated toner cartridges 9Y, 9M, 9C, 9K are not wrong in terms of color and at least one of the drum cartridges 8Y, 8M, 8C, 8K is not mounted (at least one of the drum cartridges is not present).

When the controller 100A determines that communication with at least one of the IC chips 110Y, 110M, 110C, 110K is not performed (or the controller 100A determines that at least one of the IC chips 110Y, 110M, 110C, 110K and the connectors 130 are not electrically connected to each other), the color corresponding to the mounting position of at least one of the toner cartridges 9Y, 9M, 9C, 9K does not coincide with the color information and the applying circuits are electrically conducted with all the chargers 83Y, 83M, 83C, 83K, the controller 100A determines that at least one of the toner cartridges 9Y, 9M, 9C, 9K is not mounted (at least one of the toner cartridges is not present), at least one of the toner cartridges 9Y, 9M, 9C, 9K is wrong in terms of color and all the drum cartridges 8Y, 8M, 8C, 8K are mounted (all the drum cartridges are present).

When the controller 100A determines that communication with at least one of the IC chips 110Y, 110M, 110C, 110K is not performed (or the controller 100A determines that at least one of the IC chips 110Y, 110M, 110C, 110K and the connectors 130 are not electrically connected to each other), the color corresponding to the mounting position of at least one of the toner cartridges 9Y, 9M, 9C, 9K does not coincide with the color information and the applying circuits are not electrically conducted with at least one of the chargers 83Y, 83M, 83C, 83K, the controller 100A determines that at least one of the toner cartridges 9Y, 9M, 9C, 9K is not mounted (at least one of the toner cartridges is not present), at least one of the toner cartridges 9Y, 9M, 9C, 9K is wrong in terms of color and at least one of the drum cartridges 8Y, 8M, 8C, 8K is not mounted (at least one of the drum cartridges is not present).

Subsequently, an example of processing that is to be executed by the controller 100A is described with reference to flowcharts of FIGS. 9A, 9B, 10A and 10B.

Figure 9A:
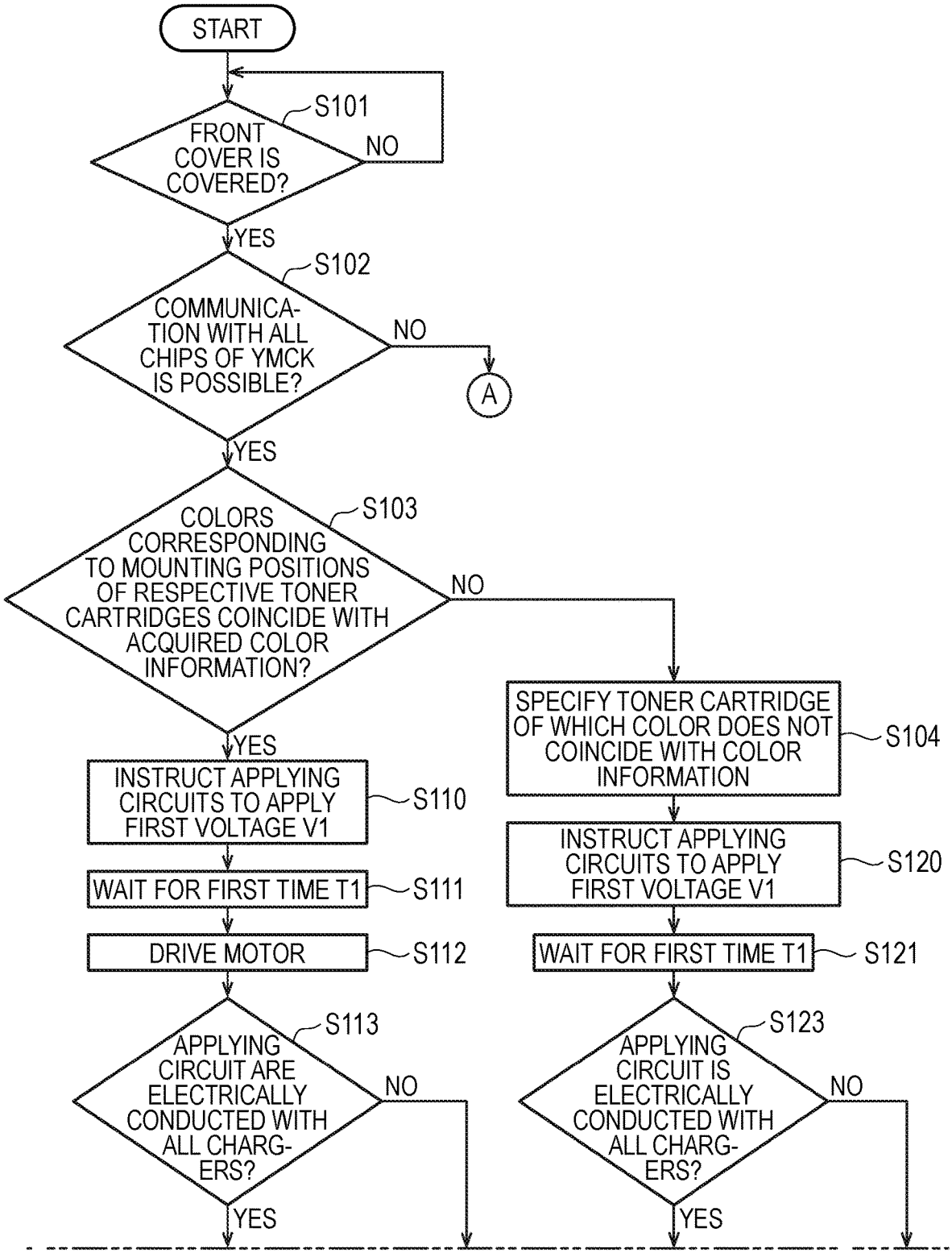
FIGS. 9A and 9B are a flowchart depicting processing of a controller in the second exemplary embodiment.
Figure 9B:
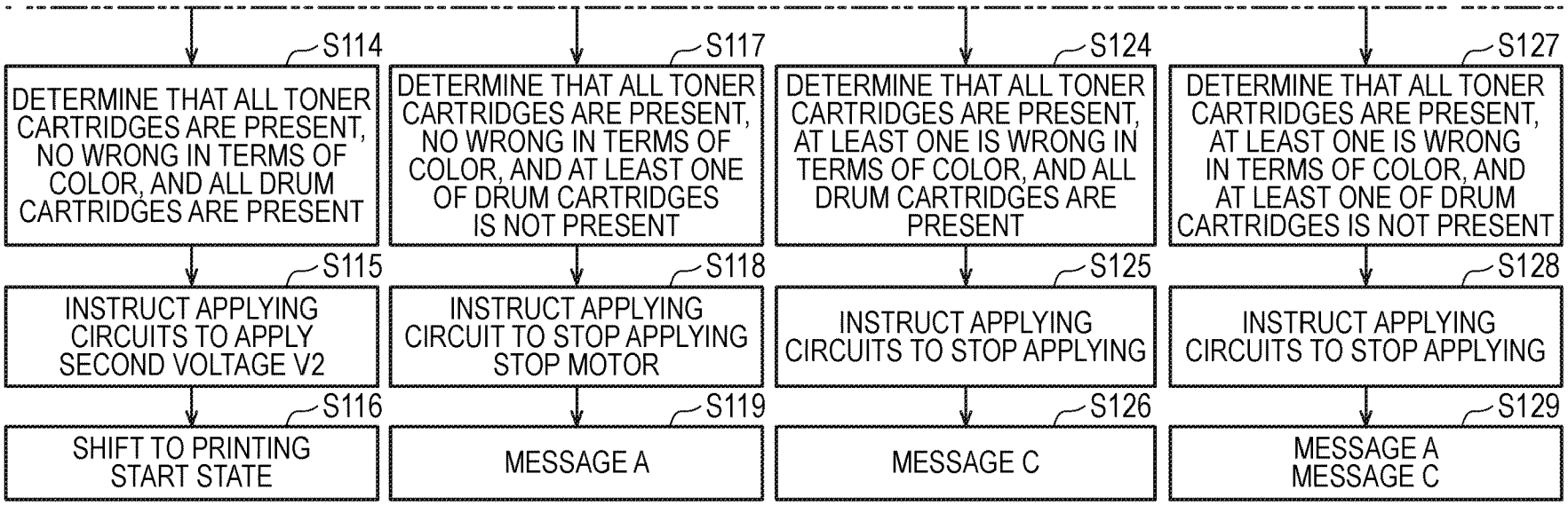

As shown in FIG. 9A, in the case that the front cover 23 is opened, the controller 100A determines whether the front cover 23 is closed (S101).

When the controller 100A determines in step S101 that the front cover 23 is not closed (S101, No), the controller 100A repeatedly executes the determination processing of step S101. On the other hand, when the controller 100A determines that the front cover 23 is closed (S101, Yes), the controller 100A tries to perform communication (or electrical connection) with the respective IC chips 110Y, 110M, 110C, 110K of the respective toner cartridges 9Y, 9M, 9C, 9K, and determines whether it is possible to perform communication with the respective IC chips 110Y, 110M, 110C, 110K (or whether it is possible to make electrical connection) (S102, the communication processing, the connection determination processing). Also, the controller 100A acquires the color information from the respective IC chips 110Y, 110M, 110C, 110K by the communication processing.

When the controller 100A determines in step S102 that it is possible to perform communication with all the IC chips 110Y, 110M, 110C, 110K (or the controller 100A determines that all the IC chips 110Y, 110M, 110C, 110K and the connectors 130 can be electrically connected to each other) (S102, Yes), the controller 100A determines whether the colors corresponding to the mounting positions of the respective toner cartridges 9Y, 9M, 9C, 9K coincide with the color information acquired in the communication processing (S103, the position determination processing).

When the controller 100A determines in step S103 that the color information and the position information of all the toner cartridges 9Y, 9M, 9C, 9K coincide with each other (S103, Yes), the controller 100A issues an instruction to cause the applying circuits to apply the first voltage V1 (S110, the transmission processing).

After step S110, the controller 100A waits for the first time T1 (S111), and drives the motor 101 (S112). Then, the controller 100A determines whether the applying circuits are electrically conducted with all the chargers 83Y, 83M, 83C, 83K (S113, the electrical conduction determination processing).

When the controller 100A determines in step S113 that the applying circuits are electrically conducted with all the chargers 83Y, 83M, 83C, 83K (S113, Yes), the controller 100A determines that all the toner cartridges 9Y, 9M, 9C, 9K are mounted (all the toner cartridges are present), all the toner cartridges 9Y, 9M, 9C, 9K are not wrong in terms of color and all the drum cartridges 8Y, 8M, 8C, 8K are mounted (all the drum cartridges are present) (S114). Then, the controller 100A issues an instruction to cause the applying circuits to apply the second voltage V2 (S115), and shifts to the printing start state (S116).

When the controller 100A determines in step S113 that the applying circuits are not electrically conducted with at least one of the chargers 83Y, 83M, 83C, 83K (S113, No), the controller 100A determines that all the toner cartridges 9Y, 9M, 9C, 9K are mounted (all the toner cartridges are present), all the toner cartridges 9Y, 9M, 9C, 9K are not wrong in terms of color and at least one of the drum cartridges 8Y, 8M, 8C, 8K is not mounted (at least one of the drum cartridges is not present) (S117). Then, the controller 100A stops the instruction to cause the applying circuits to apply the voltage, and stops the motor 101 (S118). Then, the controller 100A notifies a message A to the user (S119, the notification processing).

For example, the message A "There is no drum cartridge. Please attach the toner cartridge to the drum cartridge and then mount the drum cartridge." may be displayed on a display panel and the like (refer to FIG. 11). The message A may be notified to the user by a figure, a picture, a voice and the like.

On the other hand, when the controller 100A determines in step S103 that the color corresponding to the mounting position of at least one of the toner cartridges 9Y, 9M, 9C, 9K does not coincide with the color information acquired in the communication processing (S103, No), the controller 100A specifies the toner cartridge 9Y, 9M, 9C, 9K of which color does not coincide with the color information (S104), and issues an instruction to cause the applying circuits to apply the first voltage V1 (S120, the transmission processing).

After step S120, the controller 100A waits for the first time T1 (S121), and determines whether the applying circuits are electrically conducted with all the chargers 83Y, 83M, 83C, 83K (S123, the electrical conduction determination processing).

When the controller 100A determines in step S123 that the applying circuits are electrically conducted with all the chargers 83Y, 83M, 83C, 83K (S123, Yes), the controller 100A determines that all the toner cartridges 9Y, 9M, 9C, 9K are mounted (all the toner cartridge are present), at least one of the toner cartridges 9Y, 9M, 9C, 9K is wrong in terms of color and all the drum cartridges 8Y, 8M, 8C, 8K are mounted (all the drum cartridges are present) (S124). Then, the controller 100A stops the instruction to cause the applying circuits to apply the voltage (S125), and notifies a message C to the user (S126, the notification processing).

For example, the message C "The color of the toner cartridge is wrong. Please mount the toner cartridge to the correct position." may be displayed on the display panel and the like (refer to FIG. 11). The message C may be notified to the user by a figure, a picture, a voice and the like.

When the controller 100A determines in step S123 that at least one of the chargers 83Y, 83M, 83C, 83K is not electrically conducted with the applying circuit (or the controller 100A determines that at least one of the IC chips 110Y, 110M, 110C, 110K and the connectors 130 are not electrically connected to each other) (S123, No), the controller 100A determines that all the toner cartridges 9Y, 9M, 9C, 9K are mounted (all the toner cartridges are present), at least one of the toner cartridges 9Y, 9M, 9C, 9K is wrong in terms of color and at least one of the drum cartridges 8Y, 8M, 8C, 8K is not mounted (at least one of the drum cartridges is not present) (S127). Then, the controller 100A stops the applying of the applying circuits (S128), and notifies the message A and the message C to the user (S129, the notification processing).

Figure 10A:
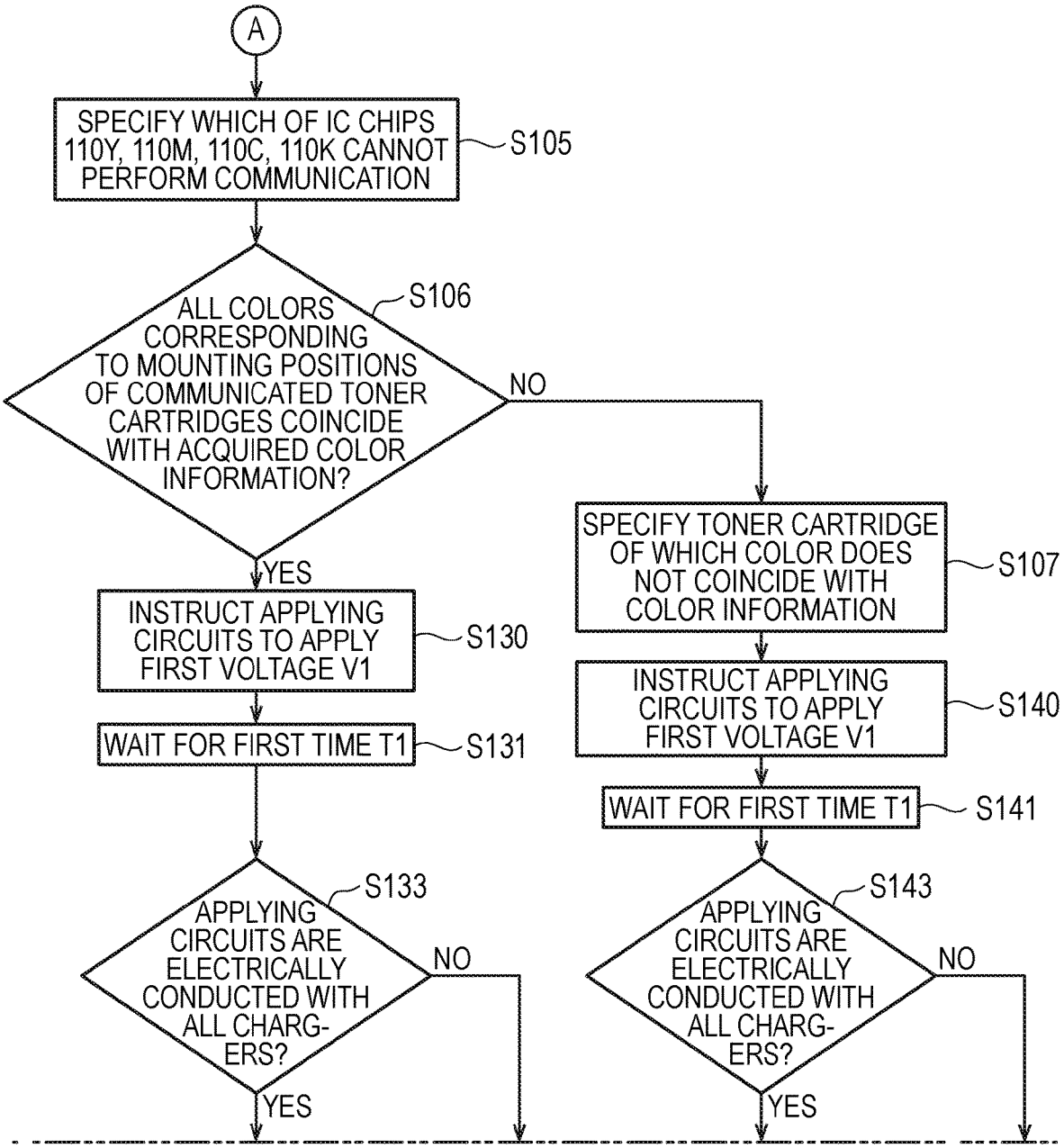
FIGS. 10A and 10B are a flowchart subsequent to FIGS. 9A and 9B.
Figure 10B:
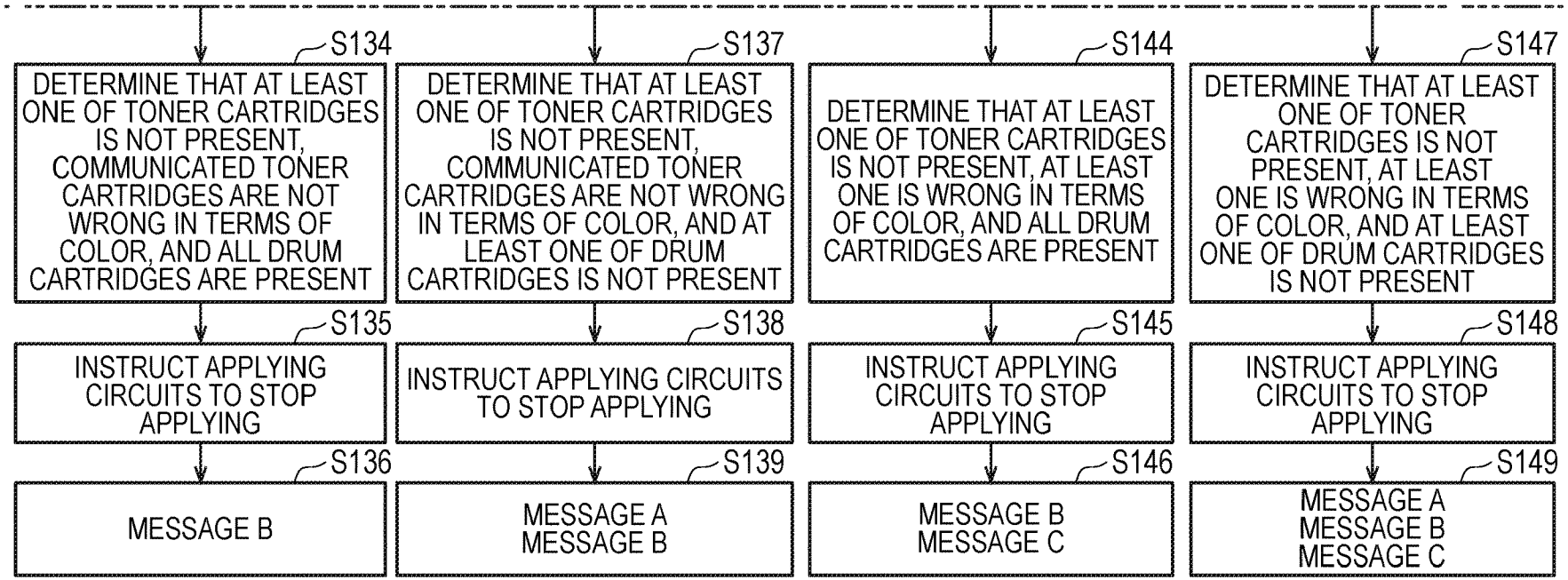

On the other hand, when the controller 100A determines in step S102 that it is not possible to perform communication with at least one of the IC chips 110Y, 110M, 110C, 110K (or the controller 100A determines that at least one of the IC chips 110Y, 110M, 110C, 110K and the connectors 130 are not electrically connected to each other) (S102, No), the controller 100A specifies which of the IC chips 110Y, 110M, 110C, 110K cannot perform communication, as shown in FIG. 10A (S105).

After step S105, the controller 100A determines whether all the colors corresponding to the mounting positions of the communicated toner cartridges 9Y, 9M, 9C, 9K coincide with the color information acquired in the communication processing (S106, the position determination processing).

When the controller 100A determines in step S106 that all the colors corresponding to the mounting positions of the communicated toner cartridges 9Y, 9M, 9C, 9K coincide with the color information acquired in the communication processing (S106, Yes), the controller 100A issues an instruction to cause the applying circuits to apply the first voltage V1 (S130, the transmission processing).

After step S130, the controller 100A waits for the first time T1 (S131), and determines whether the applying circuits are electrically conducted with all the chargers 83Y, 83M, 83C, 83K (S133, the electrical conduction determination processing).

When the controller 100A determines in step S133 that the applying circuits are electrically conducted with all the chargers 83Y, 83M, 83C, 83K (S133, Yes), the controller 100A determines that at least one of the toner cartridges 9Y, 9M, 9C, 9K is not mounted (at least one of the toner cartridges is not present), the communicated (or electrically connected) toner cartridges 9Y, 9M, 9C, 9K are not wrong in terms of color and all the drum cartridges 8Y, 8M, 8C, 8K are mounted (all the drum cartridges are present) (S134). Then, the controller 100A stops the instruction to cause the applying circuits to apply the voltage (S135), and notifies a message B to the user (S136, the notification processing).

For example, the message B "There is no toner cartridge. Please attach the toner cartridge to the drum cartridge and then mount the drum cartridge." may be displayed on the display panel and the like (refer to FIG. 11). The message B may be notified to the user by a figure, a picture, a voice and the like.

When the controller 100A determines in step S133 that at least one of the chargers 83Y, 83M, 83C, 83K is not electrically conducted with the applying circuit (S133, No), the controller 100A determines that at least one of the toner cartridges 9Y, 9M, 9C, 9K is not mounted (at least one of the toner cartridges is not present), the communicated toner cartridges 9Y, 9M, 9C, 9K are not wrong in terms of color and at least one of the drum cartridges 8Y, 8M, 8C, 8K is not mounted (at least one of the drum cartridges is not present) (S137). Then, the controller 100A stops the applying of the applying circuits (S138), and notifies the message A and the message B to the user (S139, the notification processing).

On the other hand, when the controller 100A determines in step S106 that at least one of the colors corresponding to the mounting positions of the communicated (or electrically connected) toner cartridges 9Y, 9M, 9C, 9K does not coincide with the acquired color information (S106, No), the controller 100A specifies the toner cartridges 9Y, 9M, 9C, 9K of which the color information and the position information do not coincide with each other (S107), and issues an instruction to cause the applying circuits to apply the first voltage V1 (S140, the transmission processing).

After step S140, the controller 100A waits for the first time T1 (S141), and determines whether the applying circuits are electrically conducted with all the chargers 83Y, 83M, 83C, 83K (S143, the electrical conduction determination processing).

When the controller 100A determines in step S143 that the applying circuits are electrically conducted with all the chargers 83Y, 83M, 83C, 83K (S143, Yes), the controller 100A determines that at least one of the toner cartridges 9Y, 9M, 9C, 9K is not mounted (at least one of the toner cartridges is not present), at least one of the toner cartridges 9Y, 9M, 9C, 9K is wrong in terms of color and all the drum cartridges 8Y, 8M, 8C, 8K are mounted (all the drum cartridges are present) (S144). Then, the controller 100A stops the instruction to cause the applying circuits to apply the voltage (S145), and notifies the message B and the message C to the user (S146, the notification processing).

When the controller 100A determines in step S143 that at least one of the chargers 83Y, 83M, 83C, 83K is not electrically conducted with the applying circuit (S143, No), the controller 100A determines that at least one of the toner cartridges 9Y, 9M, 9C, 9K is not mounted (at least one of the toner cartridges is not present), at least one of the toner cartridges 9Y, 9M, 9C, 9K is wrong in terms of color and at least one of the drum cartridges 8Y, 8M, 8C, 8K is not mounted (at least one of the drum cartridges is not present) (S147). Then, the controller 100A stops the instruction to cause the applying circuits to apply the voltage (S148), and notifies the message A, the message B and the message C to the user (S149, the notification processing).

The operations and effects of the image forming apparatus 1A configured as described above are described.

According to the image forming apparatus 1A, it is possible to notify the information indicating whether the drum cartridge 8 is mounted to the main body housing 2, the information indicating whether the toner cartridge 9 is mounted to the main body housing 2, and the information that the toner cartridge is wrong in terms of color, in accordance with the results of the connection determination processing, the electrical conduction determination processing and the position determination processing. For this reason, when only one of the drum cartridge 8 and the toner cartridge 9 is mounted, it is possible to notify the user that it is necessary to mount the unmounted cartridge, and to notify the information indicating that the toner cartridge is wrong in terms of color.

Although the exemplary embodiments of the present disclosure are described, the present disclosure is not limited to the exemplary embodiments. The specific configurations can be appropriately changed without departing from the gist of the present disclosure.

In the exemplary embodiments, the IC chip is exemplified as the memory. However, the memory is not limited to the IC chip inasmuch as it is possible to store the information.

In the exemplary embodiments, the controller determines whether the applying circuit is electrically conducted with the charger, based on the grid current. However, the present disclosure is not limited to the determination method. For example, for the determination, rise time of a potential of the contact point between the applying circuit and the wire electrode, or an amount of change in grid current may be used.

In the exemplary embodiments, the first voltage V1 is lower than the second voltage V2. However, the first voltage V1 may be the same as the second voltage V2.

In the exemplary embodiments, the contact-type sensor is positioned between the photosensitive drum and the registration roller. However, the contact-type sensor may be provided in other position.

In the exemplary embodiments, the laser printer is exemplified as the image forming apparatus. However, the image forming apparatus may be a copier or a complex machine.

The respective elements in the respective exemplary embodiments and the respective modified embodiments can be implemented with being arbitrarily combined.

What is claimed is:

1. An image forming apparatus comprising:

a main body housing;

a drum cartridge, which is attachable to and detachable from the main body housing and includes a photosensitive drum and a charger configured to charge a surface of the photosensitive drum;

a toner cartridge, which is attachable to and detachable from the drum cartridge and includes a memory having an electrical contact surface;

an applying circuit, which is configured to apply a voltage to the charger;

a connector, which is configured to be in contact with the electrical contact surface, and a controller, which is electrically connected to the applying circuit and the connector, the controller being configured to execute:

communication processing of performing communication with the memory via the connector to acquire information from the memory, connection determination processing of, when the communication processing is executed, determining whether electrical connection with the memory is made, transmission processing of transmitting an instruction to apply a first voltage to the charger to the applying circuit, electrical conduction determination processing of, when the transmission processing is executed, determining whether the applying circuit is electrically conducted with the charger, and notification processing of notifying information indicating whether the drum cartridge is mounted to the main body housing and information indicating whether the toner cartridge is mounted to the main body housing, in accordance with results of the connection determination processing and the electrical conduction determination processing.

2. The image forming apparatus according to claim 1, wherein when it is determined in the connection determination processing that electrical connection with the memory is made and when it is determined in the electrical conduction determination processing that the applying circuit is electrically conducted with the charger, the controller determines that the toner cartridge is mounted and the drum cartridge is mounted.

3. The image forming apparatus according to claim 1, wherein when it is determined in the connection determination processing that electrical connection with the memory is made and when it is determined in the electrical conduction determination processing that the applying circuit is not electrically conducted with the charger, the controller determines that the toner cartridge is mounted and the drum cartridge is not mounted.

4. The image forming apparatus according to claim 3, wherein when the controller determines that the toner cartridge is mounted and the drum cartridge is not mounted or when the controller determines that the toner cartridge is not mounted and the drum cartridge is mounted, the controller issues a notification indicating that it is necessary to attach the toner cartridge to the drum cartridge and then to mount the drum cartridge to the main body housing.

5. The image forming apparatus according to claim 1, wherein when it is determined in the connection determination processing that electrical connection with the memory is not made and when it is determined in the electrical conduction determination processing that the applying circuit is electrically conducted with the charger, the controller determines that the toner cartridge is not mounted and the drum cartridge is mounted.

6. The image forming apparatus according to claim 1, wherein when it is determined in the connection determination processing that electrical connection with the memory is not made and when it is determined in the electrical conduction determination processing that the applying circuit is not electrically conducted with the charger, the controller determines that the toner cartridge is not mounted and the drum cartridge is not mounted.

7. The image forming apparatus according to claim 1, wherein in the connection determination processing, it is determined whether communication with the memory, as the electrical connection, is performed.

8. The image forming apparatus according to claim 1, wherein when the controller receives an image formation command, the controller transmits an instruction to apply a second voltage to the charger to the applying circuit, and wherein the first voltage is lower than the second voltage.

9. An image forming apparatus comprising:

a main body housing;

a plurality of drum cartridges, each of which is attachable to and detachable from to the main body housing and includes a photosensitive drum and a charger configured to charge a surface of the photosensitive drum;

a plurality of toner cartridges, each of which accommodates a toner having a color different from each other, is attachable to and detachable from one of the drum cartridges, and includes a memory having an electrical contact surface;

an applying circuit, which is configured to apply a voltage to the chargers;

a plurality of connectors, each of which is configured to be in contact with the electrical contact surfaces, respectively, and a controller electrically connected to the applying circuit and the connectors, the controller is configured to execute:

communication processing of performing communication with the respective memories via the connectors to acquire color information about the toner from the respective memories, connection determination processing of, when the communication processing is executed, determining whether electrical connection with the respective memories is made, position determination processing of, when the communication processing is executed, determining whether a color corresponding to a mounting position of each of the toner cartridges coincides with the color information, transmission processing of transmitting an instruction to apply a first voltage to each of the chargers to the applying circuit, electrical conduction determination processing of, when the transmission processing is executed, determining whether the applying circuit is electrically conducted with the respective chargers, and notification processing of notifying information indicating whether the drum cartridges are mounted to the main body housing, information indicating whether the toner cartridges are mounted to the main body housing, and information indicating that the mounting position of each of the toner cartridges is wrong in terms of color, in accordance with results of the connection determination processing, the position determination processing and the electrical conduction determination processing.

10. The image forming apparatus according to claim 9, wherein when it is determined in the connection determination processing that electrical connection with all the memories is made, when it is determined in the position determination processing that the colors corresponding to the mounting positions of all the toner cartridges coincide with the color information, and when it is determined in the electrical conduction determination processing that the applying circuit are electrically conducted with all the chargers, the controller determines that all the toner cartridges are mounted, all the toner cartridges are not wrong in terms of color and all the drum cartridges are mounted.

11. The image forming apparatus according to claim 9, wherein when it is determined in the connection determination processing that electrical connection with all the memories is made, when it is determined in the position determination processing that the colors corresponding to the mounting positions of all the toner cartridges coincide with the color information, and when it is determined in the electrical conduction determination processing that the applying circuit are not electrically conducted with at least one of the chargers, the controller determines that all the toner cartridges are mounted, all the toner cartridges are not wrong in terms of color and at least of the drum cartridges is not mounted.

12. The image forming apparatus according to claim 9, wherein when it is determined in the connection determination processing that electrical connection with all the memories is made, when it is determined in the position determination processing that the color corresponding to the mounting position of at least one of the toner cartridges does not coincide with the color information, and when it is determined in the electrical conduction determination processing that the applying circuit are electrically conducted with all the chargers, the controller determines that all the toner cartridges are mounted, at least one of the toner cartridges is wrong in terms of color and all the drum cartridges are mounted.

13. The image forming apparatus according to claim 9, wherein when it is determined in the connection determination processing that electrical connection with all the memories is made, when it is determined in the position determination processing that the color corresponding to the mounting position of at least one of the toner cartridges does not coincide with the color information, and when it is determined in the electrical conduction determination processing that the applying circuit are not been electrically conducted with at least one of the chargers, the controller determines that all the toner cartridges are mounted, at least one of the toner cartridges is wrong in terms of color and at least one of the drum cartridges is not mounted.

14. The image forming apparatus according to claim 9, wherein when it is determined in the connection determination processing that electrical connection with at least one of the memories are not been made, when it is determined in the position determination processing that the colors corresponding to the mounting positions of the communicated toner cartridges coincide with the color information, and when it is determined in the electrical conduction determination processing that the applying circuit are electrically conducted with all the chargers, the controller determines that at least one of the toner cartridges is not mounted, the communicated toner cartridges are not wrong in terms of color and all the drum cartridges are mounted.

15. The image forming apparatus according to claim 9, wherein when it is determined in the connection determination processing that electrical connection with at least one of the memories is not made, when it is determined in the position determination processing that the colors corresponding to the mounting positions of the communicated toner cartridges coincide with the color information, and when it is determined in the electrical conduction determination processing that the applying circuit are not electrically conducted with at least one of the chargers, the controller determines that at least one of the toner cartridges is not mounted, the communicated toner cartridges are not wrong in terms of color and at least one of the drum cartridges is not mounted.

16. The image forming apparatus according to claim 9, wherein when it is determined in the connection determination processing that electrical connection with at least one of the memories is not made, when it is determined in the position determination processing that the color corresponding to the mounting position of at least one of the toner cartridges does not coincide with the color information, and when it is determined in the electrical conduction determination processing that the applying circuit are electrically conducted with all the chargers, the controller determines that at least one of the toner cartridges is not mounted, at least one of the toner cartridges is wrong in terms of color and all the drum cartridges are mounted.

17. The image forming apparatus according to claim 9, wherein when it is determined in the connection determination processing that electrical connection with at least one of the memories is not made, when it is determined in the position determination processing that the color corresponding to the mounting position of at least one of toner cartridges does not coincide with the color information, and when it is determined in the electrical conduction determination processing that the applying circuit are not been electrically conducted with at least one of the chargers, the controller determines that at least one of the toner cartridges is not mounted, at least one of the toner cartridges is wrong in terms of color and at least one of the drum cartridges is not mounted.

18. The image forming apparatus according to claim 9, wherein in the connection determination processing, it is determined whether communication with the memory, as the electrical connection, is performed.

* * * * *